US005948596A

United States Patent [19]

Zhong et al.

[11] Patent Number: 5,948,596

[45] Date of Patent: Sep. 7, 1999

[54] DIGITAL PRINTING PLATE COMPRISING A THERMAL MASK

[75] Inventors: Xing-Fu Zhong, Wallington, N.J.; Ken-ichi Shimazu, Briarcliff Manor, N.Y.; S. Peter Pappas, Wood-Ridge, N.J.; Tore Harms, Yorktown, N.Y.; Thi Do, West Orange, N.J.; Shashikant Saraiya, Parlin, N.J.; William P. Keaveney, Pompton Plains, N.J.

[73] Assignee: Kodak Polychrome Graphics LLC, Norwalk, Conn.

[21] Appl. No.: 08/863,770

[22] Filed: May 27, 1997

[51] Int. Cl.[6] ..... G03C 1/73

[52] U.S. Cl. ..... 430/278.1; 430/302; 430/309; 430/325; 430/326; 430/328; 430/329; 430/331; 101/454; 101/453

[58] Field of Search ..... 430/270.1, 278.1, 430/273.1, 302, 309, 325, 326, 328, 329, 331; 101/454, 453

[56] References Cited

U.S. PATENT DOCUMENTS

| | | | |
|---|---|---|---|
| 3,635,709 | 1/1972 | Kobayashi | 96/33 |
| 3,642,475 | 2/1972 | Vrancken et al. | 430/294 |
| 3,661,579 | 5/1972 | Vrancken et al. | 430/294 |
| 3,894,873 | 7/1975 | Kobayashi et al. | 96/33 |
| 4,259,905 | 4/1981 | Abiko et al. | 101/467 |
| 4,299,912 | 11/1981 | Shiba et al. | 430/302 |
| 4,342,820 | 8/1982 | Kinashi et al. | 430/11 |
| 4,348,471 | 9/1982 | Shelnut et al. | 430/165 |
| 4,350,753 | 9/1982 | Shelnut et al. | 430/190 |
| 4,447,512 | 5/1984 | Rowe et al. | 430/17 |
| 4,483,758 | 11/1984 | Rowe et al. | 204/159 |
| 5,114,479 | 5/1992 | Keaveney et al. | 106/30 |
| 5,330,875 | 7/1994 | Adelman et al. | 430/142 |
| 5,340,699 | 8/1994 | Haley et al. | 430/302 |
| 5,512,420 | 4/1996 | Hallman et al. | 430/303 |
| 5,609,980 | 3/1997 | Matthews et al. | 430/138 |

FOREIGN PATENT DOCUMENTS

| | | | |
|---|---|---|---|
| 0 599 510 A2 | 6/1994 | European Pat. Off. | G03F 7/00 |
| 0 720 057 | 7/1996 | European Pat. Off. . | |
| 01194239 | 7/1989 | Japan . | |
| 1 489 308 | 10/1977 | United Kingdom . | |
| 2273366 | 3/1996 | United Kingdom | G03F 7/00 |
| WO 96/20429 | 7/1996 | WIPO | G03F 7/022 |
| WO 97/00777 | 1/1997 | WIPO . | |

*Primary Examiner*—Maria Nuzzolillo
*Assistant Examiner*—Laura Weiner
*Attorney, Agent, or Firm*—Ratner & Prestia

[57] ABSTRACT

Presensitized lithographic plates are prepared which permit direct formation of printable images on plates by digital computerization without the intervening formation of a photographic image with a quality that allows the plates to be used for high volume printing applications. The lithographic printing plate has a structure which contains a substrate; a positive or negative working photosensitive layer; and a thermally sensitive masking layer which is opaque to the actinic radiation but which is soluble in an aqueous medium. The masking layer contains a heat softenable disperse phase which is insoluble in the aqueous medium; a polymeric continuous phase which is soluble or swellable in the aqueous medium; and a colorant which strongly absorbs radiant energy and converts the radiant energy to heat. In use the masking layer is digitally exposed to a computer controlled laser image so that exposed image areas of the masking are insolublized in the aqueous medium; soluble areas of the mask layer are then removed to form an opaque image mask on the photosensitive layer which is then exposed to actinic radiation passing through the mask to solubilize or insolubilize exposed areas of the photosensitive layer; the photosensitive layer is then developed with the developer liquid to remove the soluble areas and any overlying mask areas to form the lithographic printing plate. Both wet and waterless lithographic printing plates may be digitally prepared in this manner.

24 Claims, 3 Drawing Sheets

DIGITAL PRINTING PLATE COMPRISING A THERMAL MASK

BACKGROUND OF THE INVENTION

1. Field of the Invention

This invention relates to long impression life, laser imageable lithographic printing plates and to the method for their production. More particularly, this invention relates to lithographic printing plates for wet and waterless offset lithographic printing which can be imagewise exposed using a digitally controlled infrared laser.

2. Description of Related Art

Lithography and offset printing methods have long been combined in a compatible marriage of great convenience for the printing industry for economical high speed, high quality image duplication in small runs and large. Known art available to the industry for image transfer to a lithographic plate is voluminous but dominated by the photochemical process wherein a hydrophilic plate is coated with a photosensitive coating, exposed via a film image and developed to produce a printable, oleophilic image on the plate for use in traditional wet lithographic printing processes employing an aqueous fountain solution. Alternatively, waterless lithographic printing plates, i.e., plates that require no fountain solution, have been developed wherein a plate is photochemically produced which has oleophilic image areas and complimentary areas which are both hydrophobic and oleophobic. Such waterless plates overcome difficulties typically encountered with the traditional wet process such as the unwanted mixing and emulsification of fountain solution and ink.

With the advent of electronically controlled laser exposure systems, there is an industry trend to directly image lithographic plates by such systems instead of using the time consuming process of producing traditional litho films for imaging the plates. With such laser exposure systems, a plate is exposed by a digitally modulated laser which is scanned across the surface of the sensitive plate. However, traditional lithographic printing plates are imaged by ultraviolet radiation, whereas most lasers have output radiation in the visible and infrared spectral region. To overcome this spectral mismatch, lithographic plate structures have been developed which are sensitive to conventional laser radiation. One class of laser sensitive plates provides laser sensitivity to an oleophilic layer over the hydrophilic plate such as disclosed in U.S. Pat. No. 5,340,699, European Patent Publication 599510, and International Publication WO 20429/96. Such single layer plates which typically are sensitive to infrared lasers represent a compromise between printing performance and laser sensitivity and require additional heating or curing steps to provide an acceptable printing image. Another class of laser sensitive plates are composed of a conventional photosensitive lithographic plate which has a laser sensitive mask forming layer over the photosensitive layer of the plate such as those disclosed in U.S. Pat. Nos. 5,330,875 and 5,512,420 wherein the mask layer is a silver halide emulsion, and International Publication WO 97/00777 wherein the mask layer is a thermal ablation mask. While such laser sensitive mask/plate systems produce plates with conventional printing performance, such silver halide systems are expensive to make and process and must be handled in a dark room under dim red light; and such ablative masks require very high laser exposure doses resulting in slow imaging speed.

There continues to be a need for high speed, low cost laser imagable lithographic printing plates which are stable prior to exposure and have at least conventional printing performance.

SUMMARY OF THE INVENTION

These needs are met by the thermally-imagable digital printing plate of this invention which is a radiation sensitive plate structure comprising in the order given:

(1) a substrate;

(2) a photosensitive layer which changes solubility in a developer liquid upon exposure to actinic radiation;

(3) a thermally sensitive masking layer which is opaque to the actinic radiation and is soluble or dispersible in an aqueous medium, wherein the thermally sensitive masking layer comprises:

(i) a disperse phase comprising a heat softenable component which is insoluble in the aqueous medium;

(ii) a continuous phase comprising a polymeric binder which is soluble or swellable in the aqueous medium; and (iii) a colorant which strongly absorbs radiant energy and converts the radiant energy to heat.

An added embodiment of this invention is a method for digitally producing a lithographic printing plate comprising:

A) providing a radiation sensitive plate as described supra;

B) image-wise exposing the masking layer to a beam of a radiant energy having an intensity, by directing the beam at sequential areas of the masking layer and modulating the intensity of the beam so that image areas of the masking layer which are exposed to a high intensity of the radiant energy are insolubilized in the aqueous medium whereby a sequence of soluble mask areas and insoluble mask areas are formed;

C) developing the masking layer by removing the soluble mask areas of the mask layer from the photosensitive layer by treatment with the aqueous medium to form an opaque image mask on the photosensitive layer;

D) uniformly exposing to actinic radiation, areas of the photosensitive layer not covered by the opaque image mask, to effect a solubility change in the developer liquid to form complimentary soluble areas and insoluble areas in the photosensitive layer;

E) developing the photosensitive layer by treatment with the developer liquid to remove the soluble areas from the photosensitive layer to form the lithographic printing plate. In an optional step (F) the opaque image mask is removed from the photosensitive layer after step (D).

Another embodiment of this invention is a waterless, radiation sensitive plate comprising in the order given:

(1) a substrate;

(2) a photosensitive layer;

(2') a transparent polymeric interlayer comprised of a lipophobic material wherein upon exposure to actinic radiation, solubility of the photosensitive layer in a developer liquid changes, adhesion of the photosensitive layer to the transparent polymeric interlayer changes, or both the solubility and the adhesion changes; and (3) a thermally sensitive masking layer which is opaque to the actinic radiation and is soluble or dispersible in an aqueous medium, wherein the thermally sensitive masking layer is described supra.

Other embodiments of this invention will be describe in detail herein in the detailed description of the invention and the examples.

BRIEF DESCRIPTION OF THE DRAWINGS

The invention can be more fully understood from the following description thereof in connection with the accompanying drawings described as follows.

DETAILED DESCRIPTION OF THE INVENTION

Figure 1:
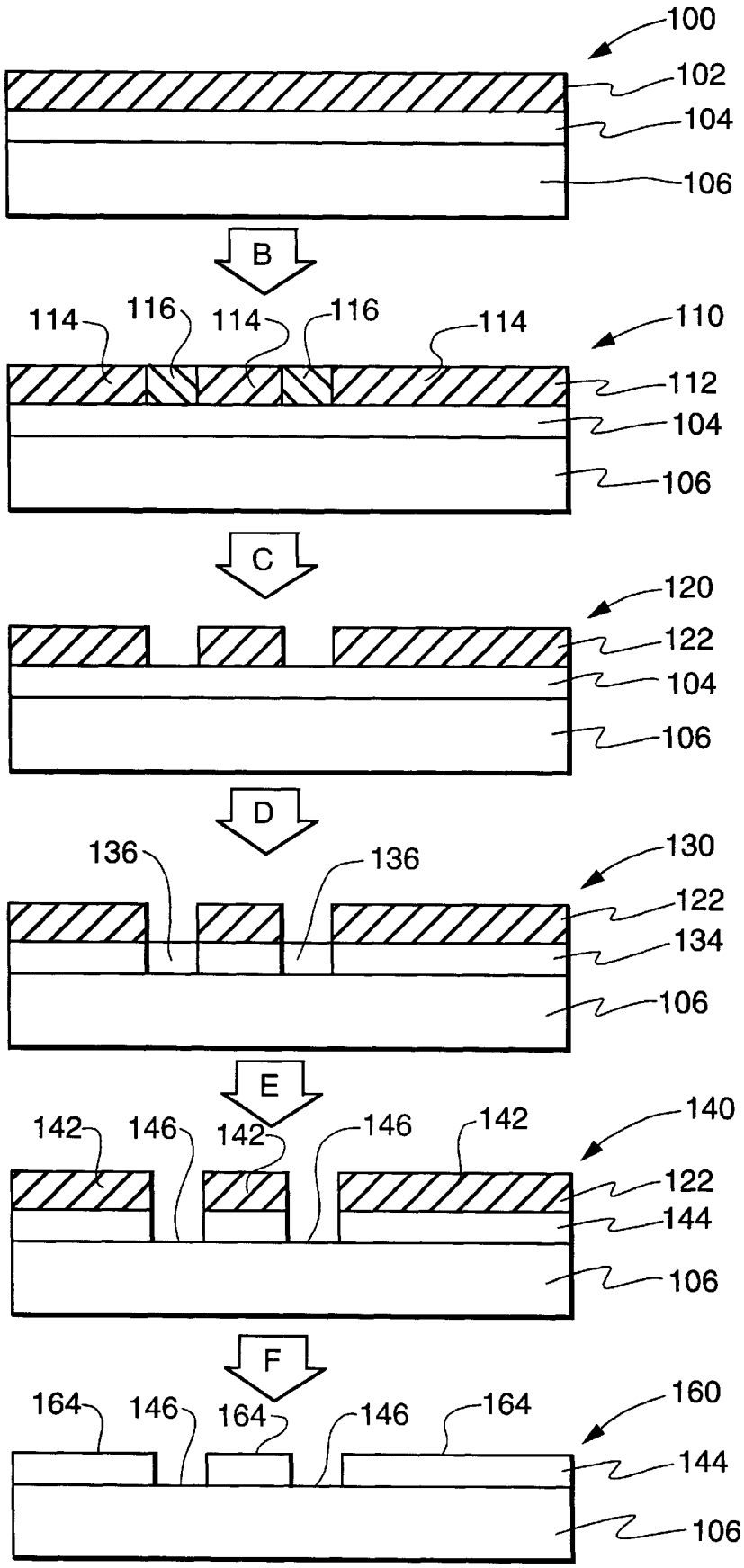
FIG. 1 is an illustration of a laser imageable plate of this invention having a developer insoluble sensitive layer and a process of preparing a plate therefrom.

The novel lithographic plates of the present invention permit the direct formation of printable images on plates by digital computerization without the intervening formation of a photographic image with a quality that allows the plates to be used for high volume printing applications of 50,000 to 1,000,000 or more copies. Basically, several related plate compositions have been discovered that utilize computer-driven infrared (IR) lasers to inscribe a developer insoluble image in a mask overcoat by thermal coalescence induced by IR light absorption. The lithographic printing plate of this invention is a radiation sensitive plate structure which comprises a substrate; a photosensitive layer which changes solubility in a developer liquid upon exposure to actinic radiation; and a thermally sensitive masking layer which is opaque to the actinic radiation and is soluble or dispersible in an aqueous medium. The thermally sensitive masking layer comprises a disperse phase comprising a heat softenable component which is insoluble in the aqueous medium; a continuous phase comprising a polymeric binder which is soluble or swellable in the aqueous medium; and a colorant which strongly absorbs radiant energy and converts the radiant energy to heat. The combination of the substrate and the photosensitive layer, along with any ancillary intermediate layers may constitute any conventional lithographic plate structure which is sensitive to actinic radiation such as ultraviolet (UV) radiation. Such conventional lithographic plate structures include positive working plates with photosolubilizable layers; negative working plates in which the photosensitive layers are insolubilized; as well as such plates which are intended for use with or without an aqueous fountain solution. The thermally sensitive masking layer may be applied over any of the commercial lithographic printing plate structures to provide the thermally-imagable digital printing plate of this invention.

The substrate or support for the printing plate of this invention may be any of those supports or substrates that are commonly used as supports in the manufacture of lithographic printing plates. Examples include metal plates such as aluminum, composite metal plates, plastic films such as polyethylene terephthalate, paper and the like. Preferably the substrate is aluminum particularly for such plates having long press life. The substrate surface may be treated or sub-coated with a material which provides either a hydrophilic character to the substrate surface for use with a fountain solution, or lipophilic character to the substrate surface for use in a "waterless" printing process. An aluminum substrate may be electrochemically treated to provide a grained surface and enhance hydrophilicity of the surface for use with fountain solutions.

The foregoing substrates are converted to photochemically presensitized (PS) lithographic plates by coating the plates with a material to form a photosensitive layer which is sensitive to actinic radiation at contact speed. The term "actinic radiation" as used herein is intended to mean radiation such as ultraviolet (UV) radiation, which can induce a chemical change in the material. The photosensitive layer, on the substrate comprises a coating sensitive to actinic radiation which yields a lipophilic image and includes radiation sensitive coatings conventionally used in radiation sensitive lithographic printing plates. The term "lipophilic" as used herein is intended to mean a surface which receives oily ink and repels water, such as for use in printing in the presence of a fountain solution. Examples of compositions constituting such radiation sensitive coatings are described in U.S. Pat. Nos. 4,299,912; 4,350,753; 4,348,471 and 3,635,709, each of which is incorporated herein by reference. These sensitive compositions include by example without limitation: compositions comprising one or more diazo resins; compositions comprising one or more o-napthoquinonediazide compounds; compositions comprising one or more radiation sensitive azide compounds; compositions comprising one or more polymers containing an alpha, beta unsaturated carbonyl group in the main or side chain thereof; and photopolymerizable compositions comprising one or more addition polymerizable unsaturated compounds.

Figure 2:
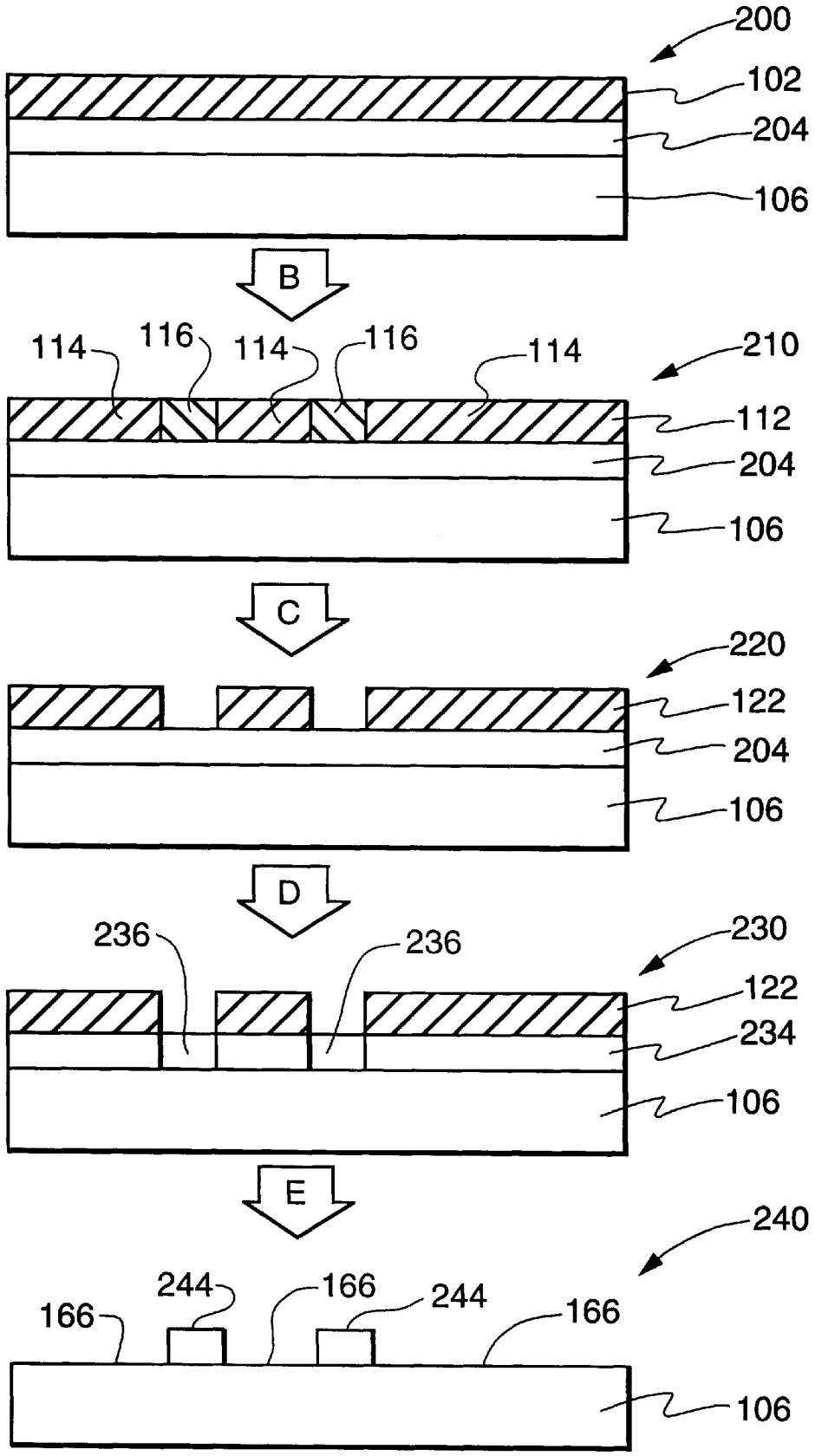
FIG. 2 is an illustration of a laser imageable plate of this invention having a developer soluble sensitive layer and a process of preparing a plate therefrom.

As used herein, the photosensitive layer which changes solubility in a developer liquid upon exposure to actinic radiation is meant to include both positive-working and negative-working photosensitive layers in the lithographic printing plates of this invention as illustrated in FIGS. 1 and 2 respectively.

As used herein, a positive-working photosensitive layer is intended to mean any photosensitive layer which is insoluble in a developer liquid and is rendered soluble in the developer liquid upon exposure to actinic radiation. Thus, as illustrated in FIG. 1, the composition of the photosensitive layer, 104, when exposed to actinic radiation such as UV, undergoes a chemical reaction in the exposed areas, 134, whereby the exposed areas, 134, become soluble and removeable. An example of a positive-working resin composition which can be developed with an aqueous alkaline solution is one which contains a radiation sensitive material such as o-napthoquinonediazide.

As used herein, negative-working photosensitive layer is intended to mean any photosensitive layer which is soluble in the developer liquid and is rendered insoluble in the developer liquid upon exposure to actinic radiation. Thus, as illustrated in FIG. 2, the composition of the photosensitive layer, 204, when exposed to actinic radiation such as UV, undergoes a chemical reaction in the exposed areas, 234, whereby the exposed areas, 234, become insoluble leaving the unexposed areas soluble or dispersible. Examples of negative-working resin compositions which can be developed following UV radiation exposure include polyvinylcinnamate, vinyl polymers containing an aromatic azide group and the like. Negative-working compositions useful in this invention are described in U.S. Pat. Nos. 4,483,758 and 4,447,512, assigned to Polychrome Corporation, each of which is incorporated herein by reference. The disclosed compositions consist of a diazo resin based on diphenyl amine sulfate condensate with formaldehyde and isolated as the 2-hydroxy-4-methoxybenzophenone-5-sulfonic acid salt. Also included are polymers with alpha, beta unsaturated carbonyl groups in the main or side chain.

Presensitized lithographic plates useful in the present invention include Vector, Virage and Winner Plates as well as the plates disclosed in the following examples each of which may be obtained from the Polychrome Corporation. Lithographic plates used in the present invention typically have speeds between about 100 and 400 mJ/cm$^2$.

Positive and negative working waterless plates have a structure which differs from conventional wet plates in that the photosensitive layer is overcoated with a silicone layer which in turn may be laminated with a strippable protective layer. In such plates the silicon layer is lipophobic and repels oily ink, whereas the photosensitive layer at least after imaging, is lipophilic. Such waterless plates are described in U.S. Pat. Nos. 3,894,873; 4,259,905 and 4,342,820 which are incorporated herein by reference. Waterless Toray™ plates of these types are available from Polychrome Corporation.

The masking layer is the outermost layer of the radiation sensitive plate structure of this invention. The thermally sensitive masking layer is opaque to the actinic radiation which activates the photosensitive layer, and is soluble or dispersible in an aqueous medium. The thermally sensitive masking layer comprises a disperse phase comprising a heat softenable component which is insoluble in the aqueous medium; a continuous phase comprising a polymeric binder which is soluble or swellable in the aqueous medium; and a colorant which strongly absorbs radiant energy and converts the radiant energy to heat. It is theorized that upon exposure to high intensity laser radiation, exposed areas are heated to the softening temperature of the disperse phase whereby the disperse phase coalesces to form an insoluble mask area. Such laser exposures are believed to thermally induce physical transition in the masking layer but may also entail a chemical transformation when one or both component(s) contains a reactive group.

The disperse phase comprises a heat-softenable component which is insoluble in an aqueous solution such as an alkaline solution. The disperse phase may be a microgel, a latex, a polymeric bead, or the like, and may contain one or more reactive groups. The disperse phase typically is an oleophilic polymer or oligomer preferably having a minimum softening temperature above ambient temperature, and it may be an addition polymer comprising segments derived from one or more monomers such as styrene, substituted styrenes, esters of acrylic acid and methacrylic acid, vinyl halides, acrylonitrile, methacrylonitrile, vinyl esters, and the like. The disperse phase may also be a condensation polymer such as a polyester, a polyamide, a polyurethane, and the like. The polymer or may also contain one or more units from functional monomers such as glycidyl acrylate and methacrylate, allyl acrylate and methacrylate, divinylbenzene, chloromethyl styrene, isocyanate and blocked isocyanate functional materials, e.g., isocyanatoethyl methacrylate and its phenol blocked derivative, amino functional monomers, e.g., dimethylaminoethyl methacrylate, methacrylamide glycolate methyl ether, N-methylol acrylamide and its derivatives.

The continuous phase comprises a heat-softenable component which is soluble or dispersible in an aqueous solution such as an alkaline solution. The continuous phase is polymeric and preferably contains carboxylic acid, sulfonic acid, or other groups capable of conferring solubility, or at least swellability, in aqueous alkaline solutions. Particularly suitable materials for the continuous phase include: copolymers derived from copolymerization of one or more ethylenically unsaturated carboxylic acids with one or more of styrene, substituted styrenes, acrylate and methacrylate esters, acrylonitrile, methacrylonitrile, or vinyl acetate; dicarboxylic acid half-esters of hydroxyl group-containing polymers, such as phthalic, succinic or maleic acid half esters of polyvinyl acetal, particularly of polyvinyl butyral; and alkyl or aralkyl half esters of styrene-maleic anhydride or alkyvinylether- maleic anhydride copolymers, particularly alkyl half esters of styrene-maleic anhydride copolymers such as Scripset® 540 (Monsanto).

The colorant may be any pigment or dyestuff which can absorb incident laser radiation, particularly infrared laser radiation. Examples of suitable laser radiation absorbing colorants include carbon black and graphite; and phthalocyanine, croconium and squarylium type dyestuffs; carboxy or sulfonate substituted polypyrrole, polythiophene or polyaniline; and mixtures thereof. A preferred colorant is carbon black pigment. The colorant may be dispersed in either the continuous phase or the disperse phase of the masking layer; or it may be dispersed in the masking layer as a separate phase. An example of a colorant dispersed in the continuous phase is Microlith black CWA (a product of Ciba-Geigy) which is carbon black dispersed in alkali soluble resin.

In addition to the colorant, the masking layer may additionally contain one or more ultraviolet absorbing compounds to enhance the opacity to actinic radiation of the mask layer. Examples of suitable ultraviolet absorbing compounds include Sudan Black B, Sudan Blue, FlexoBlue, and the like. Typically any additional UV absorbing compound is dissolved in either the continuous phase or disperse phase of the masking layer.

The colorant is present in the masking layer in an amount which is effective to cause coalescence of the coating under the influence of incident high intensity laser radiation. The colorant, as well as any additional UV absorbing compound, are present in the masking layer in sufficient amounts to render the masking layer opaque to incident actinic radiation. Typically, the masking layer should have an optical density of about 2 or greater in the spectral region of the incident radiation.

The masking layer may be formed over the printing plate top surface using any conventional coating procedure with either aqueous or non-aqueous vehicles or mixtures thereof. It is important, however, that the disperse phase should be insoluble in the chosen vehicle or mixture. The disperse phase and continuous phase may be prepared by simple mixing of preformed components, i.e., after particle formation; or may be prepared using core-shell polymerization methods as described in Keaveney et al., U.S. Pat. No. 5,114,479.

A lithographic printing plate for use in printing operations with a fountain solution may be produced by the method of this invention using a computer controlled digitally modulated laser beam to directly image the plate. The method of this invention comprises:

A) providing a radiation sensitive plate comprising in the order given:
   (1) a substrate;
   (2) a photosensitive layer which changes solubility in a developer liquid upon exposure to actinic radiation;
   (3) a thermally sensitive masking layer which is opaque to the actinic radiation and is soluble or dispersible in an aqueous medium, wherein the thermally sensitive masking layer comprises:
      (i) a disperse phase comprising a heat softenable component which is insoluble in the aqueous medium;
      (ii) a continuous phase comprising a polymeric binder which is soluble or swellable in the aqueous medium; and
      (iii) a colorant which strongly absorbs radiant energy and converts the radiant energy to heat;

B) image-wise exposing the masking layer to a beam of a radiant energy having an intensity, by directing the beam at sequential areas of the masking layer and modulating the intensity of the beam so that image areas of the masking layer which are exposed to a high intensity of the radiant energy are insolubilized in the aqueous medium whereby a sequence of soluble mask areas and insoluble mask areas are formed;

C) developing the masking layer by removing the soluble mask areas of the mask layer from the photosensitive layer by treatment with the aqueous medium to form an opaque image mask on the photosensitive layer;

D) uniformly exposing to actinic radiation, areas of the photosensitive layer not covered by the opaque image mask, to effect a solubility change in the developer liquid to form complimentary soluble areas and insoluble areas in the photosensitive layer;

E) developing the photosensitive layer by treatment with the developer liquid to remove the soluble areas from the photosensitive layer to form the lithographic printing plate; and optionally, F) removing the opaque image mask from the photosensitive layer. The method of this invention will now be described in detail in connection with the accompanying FIGS. 1 and 2. Throughout the following detailed description, similar reference characters refer to similar elements in all figures of the drawings including the embodiment to be subsequently described in connection with FIG. 3. Also in all figures of the drawings, process steps are indicated by broad open arrows containing therein the letter designator of the specific step.

Referring to FIG. 1, a radiation sensitive plate structure 100 is provided which is comprised of a substrate 106, e.g., an aluminum plate with a hydrophilic surface; a photosensitive layer 104 which is insoluble in the developer liquid and is rendered soluble in the developer liquid upon exposure to actinic radiation; and a thermally sensitive masking layer 102 which is opaque to the actinic radiation and is soluble or dispersible in an aqueous medium. Each of these layers have been described in detail supra. This plate may have additional ancillary layers such as removeable coversheets to protect the plate during storage and preliminary handling; as well as subbing and/or interlayers to enhance the proper functioning of the plate structure, e.g., to provide suitable surface, adhesion, etc. layer characteristics to the structure. In step (B) the masking layer 102 is image-wise exposed to a digitally modulated beam of a radiant energy, such as an IR laser beam. While IR laser beams are preferred, other high intensity lasers with outputs in the visible or UV may be used particularly when the thermally sensitive masking layer 102 contains carbon black as the colorant. In this step a computer controlled laser beam is directed at sequential areas of the masking layer and the intensity of the beam is modulated so that image areas 114 of the masking layer which are exposed to a high intensity of the laser energy are insolublized in an aqueous developer medium. In this step, a sequence of soluble mask areas 116 and insoluble mask areas 114 are formed in the exposed mask layer 112 of the plate 110. In step (C), the exposed masking layer 112 is developed by removing the soluble mask image areas 116 of the mask layer from the photosensitive layer 104 by treatment with the aqueous medium such as an alkaline aqueous solution, to form an opaque image mask 122 on the photosensitive layer 104 of the laser imaged plate 120. In step (D), areas of the insoluble photosensitive layer 104 not covered by the opaque image mask, are uniformly exposed to actinic radiation, such as by flood exposure of the laser imaged plate 120 to UV radiation. This flood exposure effects a solubility change to form complimentary soluble and insoluble image areas in the photosensitive layer 134 so that the areas of the photosensitive layer 136 not covered by the opaque image mask 122 which were exposed to the actinic radiation are soluble in a developer liquid such as an alkaline aqueous solution. In step (E), the exposed photosensitive layer 134 is developed by treatment with the developer liquid to remove the soluble areas 136 of the exposed photosensitive layer 134 from surface areas 146 of the substrate 106 to form the lithographic printing plate 140. In this instance, the uncovered surface areas 146 of the substrate 106 forms a hydrophilic surface receptive to wetting by a fountain solution and surface areas 142 of the opaque image mask 122 form the lipophilic printing areas of the lithographic printing plate 140. When the opaque image mask 122 functions as the printing areas, it is advantageous for the insolubilized mask to contain reactive components which may be activated by subsequent thermal or irradiation treatment to improve its printing performance characteristics. Alternatively, in an optional step (F) the opaque image mask 122 can be removed from the insoluble image areas of the photosensitive layer after step (D) and either before, during or after step (E). In this instance, the uncovered surface areas 164 of the developed photosensitive layer 144, form the lipophilic printing areas of the lithographic printing plate 160. The opaque image mask 122 may be removed with the same developer as used in step (E) or with a developer having a different activity depending on whether the mask is removed prior to or after development.

Referring to FIG. 2, a radiation sensitive plate structure 200 is similar to the radiation sensitive plate structure 100 of FIG. 1 except that the photosensitive layer 204 is soluble or dispersible in a developer liquid and is rendered insoluble upon exposure to actinic radiation. Each of these layers of the radiation sensitive plate structure 200 have been described in detail supra. This plate may have additional ancillary layers such as removeable coversheets to protect the plate during storage and preliminary handling; as well as subbing and/or interlayers to enhance the proper functioning of the plate structure, e.g., to provide suitable surface, adhesion, etc. layer characteristics to the structure. Steps (B) and (C) for preparing the opaque image mask 122 in the laser imaged plate 220 are the same as the corresponding steps described supra in reference to FIG. 1. In step (D), areas of the soluble photosensitive layer 204 not covered by the opaque image mask 122, are uniformly exposed to actinic radiation, such as by flood exposure of the laser imaged plate 220 to UV radiation. This flood exposure effects a solubility change to form complimentary insoluble and soluble image areas in the photosensitive layer 234 so that the areas of the photosensitive layer 236 not covered by the opaque image mask 122 which were exposed to the actinic radiation are insoluble in a developer liquid such as an alkaline aqueous solution. In step (E), the exposed photosensitive layer 234 is developed by treatment with the developer liquid to remove the unexposed soluble image areas of the photosensitive layer 234, along with the overlying opaque image mask 122, from surface areas 166 of the substrate 106 to form the lithographic printing plate 240. In this instance, the uncovered surface areas 166 of the substrate 106 forms a hydrophilic surface receptive to wetting by a fountain solution; and surface areas 244 of the developed photosensitive layer, form the lipophilic printing areas of the lithographic printing plate 240.

A waterless lithographic printing plate for use in printing operations without a fountain solution may be produced by the method of this invention using a computer controlled digitally modulated laser beam to directly image the plate. The method of this embodiment comprises:

A) providing a radiation sensitive plate comprising in the order given:
   (1) a substrate;
   (2) a photosensitive layer;
   (2') a transparent polymeric interlayer comprised of a lipophobic material wherein upon exposure to actinic radiation, solubility of the photosensitive layer in a developer liquid change, adhesion of the photosensitive layer to the transparent polymeric interlayer change, or both the solubility and the adhesion changes; and
   (3) a thermally sensitive masking layer which is opaque to the actinic radiation and is soluble or dispersible in an aqueous medium, wherein the thermally sensitive masking layer comprises:
      (i) a disperse phase comprising a heat softenable component which is insoluble in the aqueous medium;
      (ii) a continuous phase comprising a polymeric binder which is soluble or swellable in the aqueous medium; and
      (iii) a colorant which strongly absorbs radiant energy and converts the radiant energy to heat;

B) image-wise exposing the masking layer to a beam of a radiant energy having an intensity, by directing the beam at sequential areas of the masking layer and modulating the intensity of the beam so that image areas of the masking layer which are exposed to a high intensity of the radiant energy are insolubilized in the aqueous medium whereby a sequence of soluble mask areas and insoluble mask areas are formed;

C) developing the masking layer by removing the soluble mask areas of the mask layer from the photosensitive layer by treatment with the aqueous medium to form an opaque image mask on the photosensitive layer;

D) uniformly exposing to actinic radiation, areas of the photosensitive layer not covered by the opaque image mask, to effect an adhesion change between the photosensitive layer and the interlayer or to effect a solubility change in the developer liquid to form complimentary exposed and unexposed areas in the photosensitive layer;

E) removing overlying areas of the interlayer from either the exposed or the unexposed areas of the photosensitive layer to form complimentary image areas and non-image areas. Typically, a transparent strippable polymeric film (2") is interposed between the transparent interlayer (2') and the thermally sensitive masking layer to protect the transparent interlayer during processing. The embodiment of this invention containing the transparent strippable polymeric film (2") will now be described in the accompanying FIG. 3.

Figure 3:
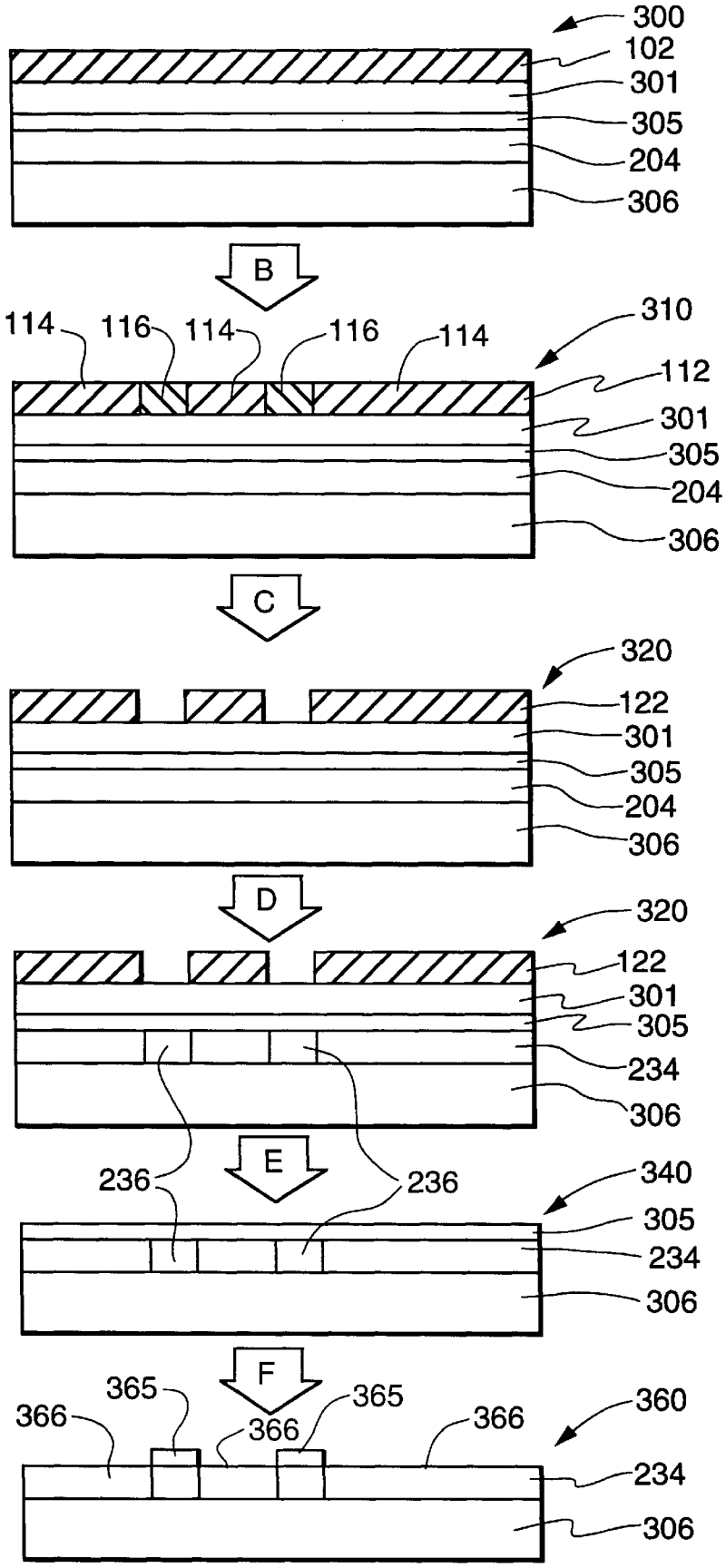
FIG. 3 is an illustration of a laser imageable waterless plate of this invention and the process of preparing a plate therefrom.

Referring to FIG. 3, a radiation sensitive plate structure 300 is provided which is comprised of a substrate 306, which may have a lipophilic surface; a photosensitive layer 204; a transparent polymeric interlayer 305 comprised of a lipophobic material such as silicone; a transparent strippable polymeric film 301 such as polyethylene or polypropylene; and a thermally sensitive masking layer 102 which is opaque to the actinic radiation and is soluble or dispersible in an aqueous medium. Each of these layers of the radiation sensitive plate structure 300 has been described in detail supra. This plate may have additional ancillary layers such as subbing and/or interlayers to enhance the proper functioning of the plate structure, e.g., to provide suitable surface, adhesion, etc. layer characteristics to the structure. Steps (B) and (C) for preparing the opaque image mask 122 in the laser imaged plate 320 are the same as the corresponding steps described supra in reference to FIG. 1. In step (D), areas of the soluble photosensitive layer 204 not covered by the opaque image mask 122, are uniformly exposed through the transparent polymeric interlayer 305 and strippable polymeric film 301, to actinic radiation, such as by flood exposure of the laser imaged plate 220 to UV radiation. This flood exposure effects an adhesion change between the photosensitive layer 204 and the interlayer 305 so that areas 236 in the photosensitive layer 234 not covered by the opaque image mask 122 which were exposed to the actinic radiation are permanently adhered to overlying portions of the transparent polymeric interlayer 305. In step (E), the strippable polymeric film 301 along with the overlying opaque image mask 122 are peeled from the transparent polymeric interlayer 305 to provide an imaged plate structure 340. In step (F) of this embodiment, areas of the interlayer 305 overlying unexposed image areas of the photosensitive layer 234 are removed with a developing liquid to provide a waterless lithographic printing plate 360 having lipophobic areas 365 and complimentary lipophilic printing areas 366 on the surface of the photosensitive layer 234. In this embodiment the photosensitive layer 234 may be flood exposed to actinic radiation after step (F) to insolubilize or harden the layer to provide a more durable printing surface. In an alternate embodiment to this method, both unexposed image areas of the photosensitive layer 234 along with the overlying areas of the interlayer 305 are removed, e.g., by treatment with an alkaline aqueous developer solution, during step (F) from the surface of the substrate 306. In this embodiment, the complimentary uncovered surface areas form the oleophilic printing surface for the waterless printing plate.

In still a further embodiment of the waterless plate of this invention, not illustrated in the Figures, the opaque mask layer is applied directly onto the surface of the lipophobic interlayer and the sensitized waterless plate is processed as described supra in reference to FIG. 3 except that the mask image is removed with a developer liquid therefor.

The infrared laser-imagable digital printing plates of this invention will now be illustrated by the following examples but the invention is not intended to be limited thereby.

EXAMPLE 1

An IR laser sensitive printing plate having an insoluble photosensitive layer was prepared as follows:

A reactive microgel was prepared from an initiator-surfactant mixture of 3.04 g sodium dodecyl sulfate, 1.66 g ammonium persulfate, and 520 g deionized (DI) water; and a monomer mixture of 147.4 g styrene, 9.6 g glycidyl methacrylate, and 7.7 g divinylbenzene (55%). The initiator-surfactant mixture was stirred mechanically in a 2 liter round bottom flask under nitrogen, and heated to 70° C. The monomer mix was added dropwise during 105 minutes. The polymerization was allowed to continue for 3 additional hours under nitrogen at 70° C. A microgel was obtained containing 24.5% solids.

A carbon black dispersion was prepared as follows: 120 g of DI water, 160 g of isopropanol and 40 g of ammonium hydroxide (28–30% $NH_3$) were added to 80 g Microlith black CWA (a product of the Ciba-Geigy Corporation). Microlith black CWA is specified as carbon black dispersed in alkali soluble resin. The mixture was shaken with steel beads by a high speed shaker for one hour and then passed through a shot mill for three consecutive times. A dispersion was obtained containing 19.2% solids.

45 g of the microgel and 34 g of the carbon black dispersion were mixed and 194 g DI water and 92 g isopropanol where then added. The mixture was stirred for 15 minutes and then coated on the photosensitive surface of a Vector P95 positive plate (a product of Polychrome Corporation) and dried to give an opaque layer with a coating weight of 1.2 g/m$^2$. The plate was imaged by exposing the black layer to the YAG laser (having a spectral output at 1064 nm) of a Gerber Crescent/42T Platesetter. A similar plate was imaged by the IR diode laser (having a spectral output at 830 nm) of a CREO Trendsetter exposure device (a product of the CREO Corporation British Columbia, Canada) After a first development in PC 955 negative developer (a product of the Polychrome Corporation) diluted to 10% in water, the plate was flood exposed to UV radiation using a conventional contact exposure frame. A second development in PC 4000 positive developer (a product of the Polychrome Corporation, Fort Lee N.J.), gave an image for both the 1864 nm and 830 nm laser imaged plates in which the laser exposed area became the image layer.

EXAMPLE 2

An IR laser sensitive printing plate having a soluble photosensitive layer which becomes insoluble by UV irradiation was prepared by coating a carbon black dispersion prepared as in Example 1 onto the photosensitive surface of a Polychrome Winner negative plate (a product of the Polychrome Corporation) and dried to give an opaque layer with a coating weight of 1.2 g/m$^2$. The opaque coating was laser imaged, developed and flood exposed to UV radiation as described in Example 1. A second development in a PC 952 negative developer (a product of the Polychrome Corporation), removed both the laser exposed image areas and the underlying unexposed areas of the soluble sensitive layer to give a high quality image in which the printing image comprised the areas not exposed to laser irradiation.

EXAMPLE 3

An IR laser sensitive waterless printing plate was prepared by coating a carbon black dispersion prepared as in Example 1 onto a transparent coversheet of a Toray® positive waterless plate (a product of the Toray Corporation) and dried to give an opaque layer with a coating weight of 1.2 g/m$^2$. (This waterless plate was composed of a substrate, a photosensitive layer, a silicone layer and a removeable transparent coversheet.) The opaque coating was laser imaged, developed and flood exposed to UV radiation as described in Example 1. Then the coversheet together with the overlying black image, was peeled from the plate surface and the plate was developed in a Toray positive waterless developer (HP-7N) to remove overlying areas of the silicone layer from the unexposed areas of the photosensitive layer to give a high quality image in which the unexposed areas of the photosensitive layer became the ink receptive image areas.

EXAMPLE 4

A dye containing fortified latex which was synthesized in accordance with the procedure as described in example II of U.S. Pat. No. 5,114,479 except that a Sudan Black B dispersion was prepared as follows: 300 g Joncryl 89 (Available from SC Johnson Corporation) which is a styrenated acrylic polymer emulsion, having MW 200,000 and acid number 50, and 20 g of DI water were mixed in a conventional lab glass container. The reaction mixture was heated to 55° C. under nitrogen. Then 10 g of Sudan Black B was added at 55° C. and the mixture was further heated to 93° C. for three hours. The dispersion was cooled and filtered at 55° C. The yield of the Sudan Black dispersion was 96% with 47.2% nonvolatiles, a viscosity of 213 CPS, and a pH=8.18. A coating solution was prepared by dissolving 23.9 g (47.12% non-volatile) of the dye containing core-shell latex, 200.3 g of DI water, 100.9 g of methanol and 38.2 g of (18.6% non-volatile) carbon black dispersion of Example 1. The mixture was stirred for 15 minutes and then the solution was whirler coated on a Polychrome positive (T-41) plate at 70 rpm and dried at 60° C. for 3 minutes to produce a plate having a coating weight 1.2 to 1.3 g/m$^2$. The plate was imaged by the YAG laser (1064 nm) of a Gerber Cresent/42T Platesetter or by an IR diode laser (830 nm) on. After the first development with developer PC-955, the plate was flood exposed to UV light at 220 mJ/cm$^2$, followed by a second development in a PC-3000 positive developer (a product of the Polychrome Corporation). An image was obtained corresponding to the laser exposed area.

EXAMPLE 5

Example 4 was repeated except that the dispersion contained 4.42 g of Sudan Blue 670 and 5.58 g of FlexoBlue in place of Sudan Black B. An image was obtained on the plate which corresponded to the laser exposed area.

EXAMPLE 6

A polystyrene latex was prepared by the method described in Example 1 except that neither glycidyl methacrylate nor divinylbenzene was added.

45 g of polystyrene latex and 34 g of carbon black dispersion were mixed. 194 g of deionized water and 92 of isopropanol were added. The mixture was stirred for 15 min. It was coated on the photosensitive surface of a Vector P95 positive plate (a product of the Polychrome Corporation). The coating weight was 1.20 g/m$^2$. The plate was imaged by exposing the black layer to a YAG laser (having a spectral output at 1064 nm) on Gerber Crescent/42T Platesetter. A similar plate was imaged by an IR diode laser (having spectral output at 830 nm) on a CREO Trendsetter exposure device. After the first development in PC 955 negative developer (available from the Polychrome Corporation) diluted to 120% in water, the plate was flood exposed to UV radiation using a conventional contact exposure frame. A second development in PC 4000 positive developer (a product of the Polychrome Corporation), gave an image for both the 1064 nm and 830 nm laser imaged plates in which the laser exposed area became image layer.

EXAMPLE 7

A copolymer latex of styrene and glycidyl methacrylate was prepared in the same way as described in Example 1 except that 1 part of glycidyl methacrylate vs. 15 parts of styrene was added, and no divinylbenzene was added.

45 g of copolymer latex and 34 g of carbon black dispersion were mixed. 194 g of deionized water and 92 of isopropanol were added. The mixture was stirred for 15 min. It was coated on the photosensitive surface of a Vector P95,positive plate (available from the Polychrome Corporation). The coating weight was 1.20 g/m$^2$. The plate was imaged by exposing the black layer to a YAG laser (having spectral output at 830 nm) on a CREO Trendsetter exposure device. After the first development in PC 955 developer (a product of the Polychrome Corporation) diluted to 10% in water, the plate was flood exposed to UV radiation using a conventional contact exposure frame. A second development in PC 4000 positive developer (a product of the Polychrome Corporation), gave an image for both the 1064 nm and 830 nm laser imaged plates in which the laser exposed area became image layer.

EXAMPLE 8

A poly(n-butyl methacrylate) latex was prepared in the same way as described in Example 1 except that styrene was replaced by n-butyl methacrylate, and neither glycidyl methacrylate nor divinylbenzene was added.

45 g of poly (n-butyl methacrylate) latex and 34 g of carbon black dispersion were mixed. 194 g of deionized water and 92 of isopropanol were added. The mixture was stirred for 15 min. It was coated on the photosensitive surface of a Vector P95 positive plate (a product of the Polychrome Corporation). The coating weight was about 1.20 g/m$^2$. The plate was imaged by exposing the black layer to a YAG laser (having a spectral output at 1064 nm) on Gerber Crescent/42T Platesetter. A similar plate was imaged by an IR diode laser (having spectral output at 830 nm) on a CREO Trendsetter exposure device. After the first development in PC 955 negative developer (available from the Polychrome Corporation) diluted to 10% in water, the plate was flood exposed to UV radiation using a conventional contact exposure frame. A second development in PC 4000 positive developer (available from the Polychrome Corporation), gave an image for both the 1064 nm and 830 nm laser imaged plates in which the laser exposed area became image layer.

Those skilled in the art having the benefit of the teachings of the present invention as hereinabove set forth, can effect numerous modifications thereto. These modifications are to be construed as being encompassed within the scope of the present invention as set forth in the appended claims.

What is claimed is:

1. A radiation sensitive plate structure comprising in the order given:

(a) a substrate;

(b) a photosensitive layer which changes solubility in a developer liquid upon exposure to actinic radiation;

(c) a thermally sensitive masking layer which is opaque to the actinic radiation and is soluble or dispersible in an aqueous medium, wherein the thermally sensitive masking layer comprises:

(i) a disperse phase comprising a heat softenable component which is insoluble in the aqueous medium;

(ii) a continuous phase comprising a polymeric binder which is soluble or swellable in the aqueous medium; and (iii) a colorant which strongly absorbs radiant energy and converts the radiant energy to heat.

2. The radiation sensitive plate structure of claim 1 wherein the substrate has a hydrophilic surface which is contiguous to the photosensitive layer.

3. The radiation sensitive plate structure of claim 2 wherein the substrate is an aluminum plate.

4. The radiation sensitive plate structure of claim 1 wherein the photosensitive layer is insoluble in the developer liquid and rendered soluble in the developer liquid upon exposure to actinic radiation.

5. The radiation sensitive plate structure of claim 1 wherein the photosensitive layer is soluble in the developer liquid and is rendered insoluble in the developer liquid upon exposure to actinic radiation.

6. The radiation sensitive plate structure of claim 1 wherein the heat softenable component is a polymeric latex particle, a polymeric microgel, a polymeric core-shell particle, or a combination thereof.

7. The radiation sensitive plate structure of claim 1 wherein the polymeric binder is a polymer containing hydroxyl groups, amino groups, carboxylic acid groups, sulfonic acid groups, sulphonamic acid groups, or a combination thereof.

8. The radiation sensitive plate structure of claim 1 wherein the colorant comprises a pigment, a dyestuff, or a combination thereof.

9. The radiation sensitive plate structure of claim 1 wherein the thermally sensitive masking layer contains an ultraviolet absorbing material.

10. The radiation sensitive plate structure of claim 1 wherein a polymeric interlayer is between the photosensitive layer and the thermally sensitive masking layer.

11. The radiation sensitive plate structure of claim 10 wherein the polymeric interlayer is comprised of a lipophobic material.

12. The radiation sensitive plate structure of claim 10 wherein the polymeric interlayer is comprised of a silicone material.

13. The radiation sensitive plate structure of claim 12 wherein a polymeric film is between the polymeric interlayer and the thermally sensitive masking layer.

14. The radiation sensitive plate structure of claim 1 wherein a hydrophilic sub layer is between the substrate and the photosensitive layer.

15. A method for digitally producing a lithographic printing plate comprising:

A) providing a radiation sensitive plate comprising in the order given:

(a) a substrate;

(b) a photosensitive layer which changes solubility in a developer liquid upon exposure to actinic radiation;

(c) a thermally sensitive masking layer which is opaque to the actinic radiation and is soluble or dispersible in an aqueous medium, wherein the thermally sensitive masking layer comprises:

(i) a disperse phase comprising a heat softenable component which is insoluble in the aqueous medium;

(ii) a continuous phase comprising a polymeric binder which is soluble or swellable in the aqueous medium; and (iii) a colorant which strongly absorbs radiant energy and converts the radiant energy to heat;

B) image-wise exposing the masking layer to a beam of a radiant energy having an intensity, by directing the beam at sequential areas of the masking layer and modulating the intensity of the beam so that image areas of the masking layer which are exposed to a high intensity of the radiant energy are insolubilized in the aqueous medium whereby a sequence of soluble mask areas and insoluble mask areas are formed;

C) developing the masking layer by removing the soluble mask areas of the mask layer from the photosensitive layer by treatment with the aqueous medium to form an opaque image mask on the photosensitive layer;

D) uniformly exposing to actinic radiation, areas of the photosensitive layer not covered by the opaque image mask, to effect a solubility change in the developer liquid to form complimentary soluble areas and insoluble areas in the photosensitive layer;

E) developing the photosensitive layer by treatment with the developer liquid to remove the soluble areas from the photosensitive layer to form the lithographic printing plate.

16. The method of claim 15 wherein the photosensitive layer is insoluble in the developer liquid; wherein after step (D), the areas of the photosensitive layer not covered by the opaque image mask which were exposed to the actinic radiation are soluble in the developer liquid; and wherein during step (E) the soluble areas of the photosensitive layer are removed from the substrate.

17. The method of claim 16 wherein after step (D) and either before, during or after step (E), the insoluble mask areas of the opaque image mask are removed from the insoluble image areas of the photosensitive layer.

18. The method of claim 15 wherein the photosensitive layer is soluble in the developer liquid; wherein after step (D), the areas of the photosensitive layer not covered by the opaque image mask which were exposed to the actinic radiation are insoluble in the developer liquid; and wherein during step (E), the insoluble mask image of the opaque image mask and the soluble areas of the photosensitive layer are removed from the substrate.

19. The method of claim 15 wherein the beam of radiant energy is an infra-red laser beam.

20. The method of claim 15 wherein the actinic radiation is ultraviolet radiation or visible light.

21. A method for digitally producing a waterless lithographic printing plate comprising:

A) providing a radiation sensitive plate comprising in the order given:

(1) a substrate;

(2) a photosensitive layer;

(2') a transparent polymeric interlayer comprised of a lipophobic material wherein upon exposure to actinic radiation, solubility of the photosensitive layer in a developer liquid changes, adhesion of the photosensitive layer to the transparent polymeric interlayer change, or both the solubility and the adhesion changes; and (3) a thermally sensitive masking layer which is opaque to the actinic radiation and is soluble or dispersible in an aqueous medium, wherein the thermally sensitive masking layer comprises:

(i) a disperse phase comprising a heat softenable component which is insoluble in the aqueous medium;

(ii) a continuous phase comprising a polymeric binder which is soluble or swellable in the aqueous medium; and (iii) a colorant which strongly absorbs radiant energy and converts the radiant energy to heat;

B) image-wise exposing the masking layer to a beam of a radiant energy having an intensity, by directing the beam at sequential areas of the masking layer and modulating the intensity of the beam so that image areas of the masking layer which are exposed to a high intensity of the radiant energy are insolubilized in the aqueous medium whereby a sequence of soluble mask areas and insoluble mask areas are formed;

C) developing the masking layer by removing the soluble mask areas of the mask layer from the photosensitive layer by treatment with the aqueous medium to form an opaque image mask on the photosensitive layer;

D) uniformly exposing to actinic radiation, areas of the photosensitive layer not covered by the opaque image mask, to effect an adhesion change between the photosensitive layer and the interlayer or to effect a solubility change in the developer liquid to form complimentary exposed and unexposed areas in the photosensitive layer;

E) removing overlying areas of the interlayer from either the exposed or the unexposed areas of the photosensitive layer to form complimentary image areas and non-image areas.

22. The method of claim 21 wherein the photosensitive layer is a lipophilic material.

23. The method of claim 21 wherein during step (D) complimentary soluble areas and insoluble areas are formed in the photosensitive layer; and during step (E) the soluble areas are removed from the photosensitive layer by treatment with the developer liquid along with the overlying areas of the interlayer to form the lithographic printing plate.

24. The method of claim 21 wherein a transparent strippable polymeric film is interposed between the transparent interlayer and the thermally sensitive masking layer; and wherein after step (D) and before step (E), the transparent strippable polymeric film along with the opaque image mask is removed from the polymeric interlayer.

* * * * *